US005437066A

United States Patent [19]

Mills et al.

[11] Patent Number: 5,437,066

[45] Date of Patent: Aug. 1, 1995

[54] SEAT ACTUATED TOILET BOWL LIGHT

[76] Inventors: Richard Mills, 609 Jacie Ct., Burleson, Tex. 76028; William R. Bradford, 221 Haywood, Benbrook, Tex. 76126; John F. Bryan, Jr., 3510 Woodcreek Cir., Parker, Tex. 75002

[21] Appl. No.: 224,267

[22] Filed: Apr. 8, 1994

[51] Int. Cl.[6] ..... E03D 9/00

[52] U.S. Cl. ..... 4/661; 362/191

[58] Field of Search ..... 4/661, 237, 240; 362/191, 802

[56] References Cited

U.S. PATENT DOCUMENTS

| | | | |
|---|---|---|---|
| 4,413,364 | 11/1983 | Bittaker et al. | 4/661 |
| 4,736,471 | 4/1988 | Johnson | 4/661 X |
| 4,860,178 | 8/1989 | Picon | 362/101 |
| 5,003,648 | 4/1991 | Anderson | 4/661 |
| 5,029,055 | 7/1991 | Lindh | 362/191 |
| 5,036,443 | 7/1991 | Humble et al. | 362/183 |
| 5,150,962 | 9/1992 | Rauschenberger | 362/101 |
| 5,263,209 | 11/1993 | Pattee | 4/661 |

*Primary Examiner*—Robert M. Fetsuga
*Attorney, Agent, or Firm*—John F. Bryan, Jr.

[57] ABSTRACT

A lamp assembly having a gravity actuated switch and battery power is provided for attachment to a toilet seat ring at the rearward portion thereof, proximate the pivotal axis of attachment of the seat ring, so as to be rotated from a position remote from the toilet bowl interior when the seat ring is in the "down" position with the lamp inactive and directed at the toilet bowl interior when the seat ring is in the "up" position and the light is consequently operative.

7 Claims, 2 Drawing Sheets

SEAT ACTUATED TOILET BOWL LIGHT

FIELD OF THE INVENTION

The present invention relates to the field of toilet bowl lights and most particularly, to such lights mounted to the toilet seat and actuated by raising the seat to the vertical position.

BACKGROUND AND SUMMARY OF THE INVENTION

Night time use of the toilet begs for some degree of illumination, but not so bright as to disrupt the user's night adapted vision. The man of the house will appreciate the benefit of a lighted target and the lady may be spared annoyance. A light activated by seat position will also provide socially desireable training to the toilet seat positionally insensative male. While prior art has offered numerous devices wherein a light, activated by raising the seat, illuminates a toilet bowl, no such item is available in today's market. Cost, of course, is always a factor in the volume of sales of any non-essential item, but the fact that prior offerings have not gained popular acceptance indicates that an unperceived aspect of the need is yet to be satisfied.

Applicant has identified sanitation as an inherent failing common to all previous offerings. Any device installed in an exposed area, either on the seat ring or in the bowl is inevitably subject to contamination, particularly fecal splatter. An object of the present invention is therefore, to provide bowl illumination by a seat ring position actuated device which is not exposed to such contamination. A second object is to provide such a device in a simple unit having inexpensive and easily assembled components.

The present invention accomplishes these objectives by providing a device which, unlike previous teachings, fits on the rearmost, near vertical, face of a toilet seat ring. Here, the device moves away from the bowl interior as the seat ring rotates downward to the horizontal position and rotates forward to illuminate the bowl when the seat is raised to the vertical position. A switch is provided to activate the device and illuminate the bowl when the seat ring is vertical.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
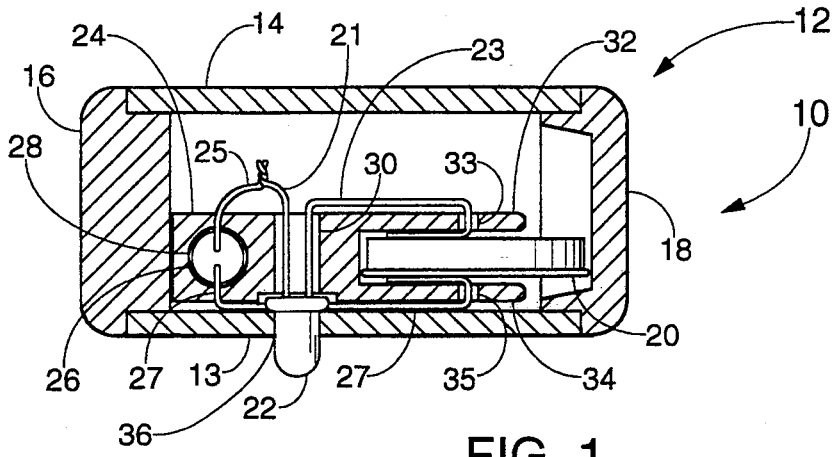
FIG. 1 shows a cross-section of a preferred embodiment of the present invention.
Figure 2:
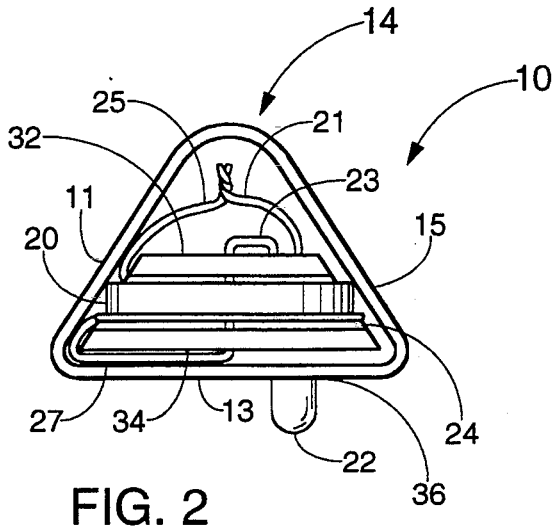
FIG. 2 shows and end view of the embodiment of FIG. 1.

FIGS. 1 and 2 show the configuration of the preferred embodiment 10 of the present invention. Here, it is seen that housing assembly 12 comprises a tubular cover 14 with end caps 16 and 18. End cap 16 is not necessarily removable but end cap 18 is made so for the replacement of 3 volt wafer type battery 20. A light emitting diode (LED) is preferred for lamp 22 by virtue of small size, low power consumption and the low intensity light output which is well suited to this usage. Inner member 24 provides a mounting frame for battery 20, lamp 22 and gravity actuated electrical switch 26. In preferred embodiment 10, switch 26 is provided as a commercially available mercury switch and battery 20 is a commercially available 500 milliamp-hr. wafer battery. Inner member 24 fits inside of tubular cover 14 and has a first receiving cavity 28 which holds switch 26 and a second receiving cavity 30 which holds lamp 22. Inner member 24 includes first and second clamping arms 32 and 34, pierced by first hole 33 and second hole 35 respectively and extending so as to grip battery 20. Lamp 22 has lead wires 21 and 23 which extend through second receiving cavity 30 and switch 26 has lead wires 25 and 27 which extend from first receiving cavity 28. Lead wires 21 and 25 are joined to connect lamp 22 to switch 26 and lead wires 23 and 27 are extended to pass through first hole 33 and second hole 35 respectively, contacting the opposite poles of battery 20. In this manner an electrical circuit is completed when switch 26 is actuated.

The external contour of housing tube 14 has a bottom wall 13 and inwardly inclined side walls 11 and 15 which join together as a radiused top. The cross-sectional shape of housing tube 14 can be distorted upon insertion of inner member 24 to accept protruding lamp 22 and has a closely fitted hole 36 indexed to receive lamp 22. The inward inclination of side walls 11 and 15 bear against the body of inner member 24 once it is in place and hold it firmly against movement. It is notable that, so positioned, gravity actuated switch 26 is oriented transversely parallel to bottom wall 13. Insertion of closely fitted end caps 16 and 18 completes the sealed, watertight assembly of preferred embodiment 10 and stabilizes the shape of housing tube 14.

Figure 3:
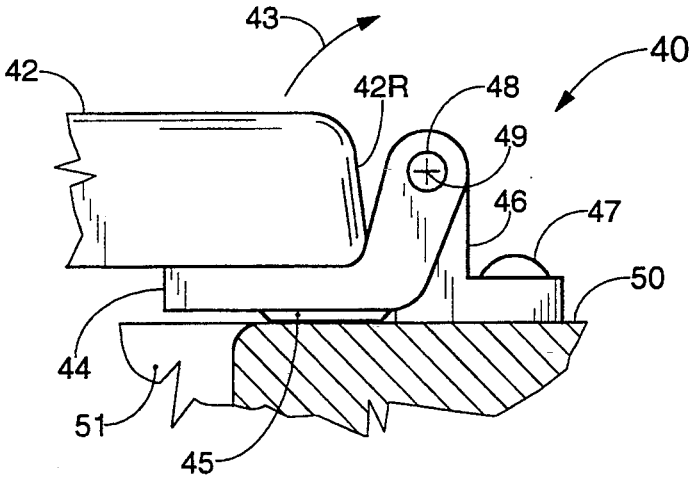
FIG. 3 shows a partial view of the pivotally attached end of the most common toilet seat configuration.

FIG. 3 shows a partial view of toilet assembly 40, omitting the cover portion as being unrelated to either the installation or operation of the present invention. Base brackets 46 are bolted to the upper surface of toilet bowl 50 by bolts 47. Seat ring 42 is of the traditional shape and is pivotally connected at rearward face 42R by two ring leafs 44 to base brackets 46 at pins 48. Ring leafs 44 include a support pad portion 45 which contacts the upper surface of bowl 50 when seat ring 42 is extended horizontally over bowl interior 51. Seat ring 42 pivots upwardly about the axis 49 of pins 48 from the shown horizontal position to a raised, vertical position as indicated by arrow 43.

Figure 4:
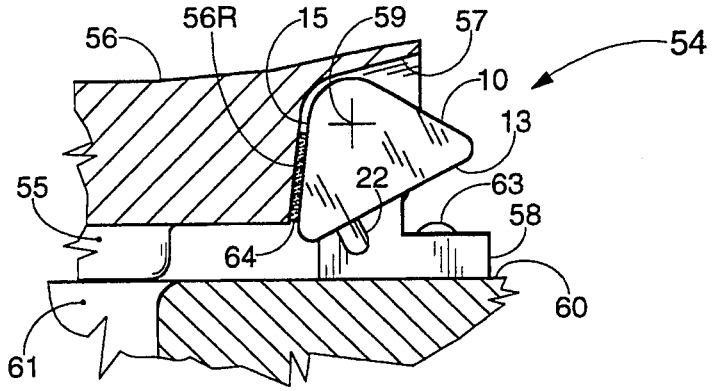
FIG. 4 shows a cross-section of the hinged end of a popular toilet seat configuration with the preferred embodiment of the invention installed.

FIG. 4 shows a section view of a second toilet assembly 54 with an installation the present invention. The configuration of seat ring 56 is that of a molded plastic part with integrated means for pivotal connection to base bracket 58 so as to rotate about axis 59. The molded form of seat ring 56 also includes support pads 55 and recess 57, extending from rear face 56R to receive base brackets 58. Base brackets 58 are then attached to toilet bowl 60 by bolts 63 to complete the pivotal mounting of seat ring 56. Preferred embodiment 10 of the present invention is fitted into recess 57 with inclined wall 15 attached to rear face 56R of seat ring 56 by double sided adhesive strip 64. Bottom wall 13 is thus inclined so that gravity actuated switch 26, which lies parallel thereto, is electrically open when seat ring 56 is horizontal as shown here. Thus, by rotation of seat ring 56 to the horizontal position, lamp 22 is both extinguished and displaced horizontally away from interior 61 of bowl 60 to a protected location not exposed to fecal splatter or similar contamination.

Figure 5:
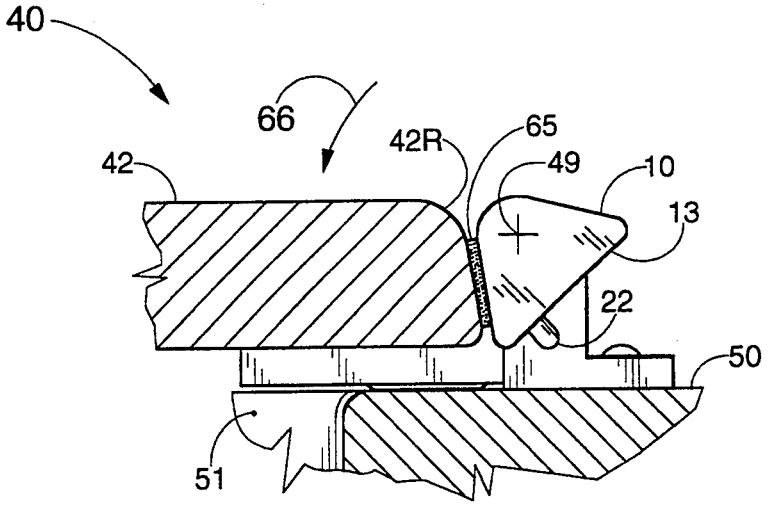
FIG. 5 shows a cross-section of the toilet seat of FIG. 3 with the preferred embodiment of the invention installed.

FIG. 5 shows a section view of toilet seat assembly 40 with the added installation of the present invention. Again, as in FIG. 3, seat ring 42 is shown to be rotated about pivot axis 49 to its "down" or horizontal position as indicated here by arrow 66. Preferred embodiment 10 of the present invention is attached by double sided adhesive strip 65 to the vertically inclined rear face 42R of seat ring 42. As previously described, the resulting inclination of switch 26 results in an open electrical circuit and lamp 22 is inactive. Again, as in FIG. 4, lamp 22 is displaced horizontally and protected from exposure to interior 51 of toilet bowl 50 when seat ring 42 is rotated downwardly.

Figure 6:
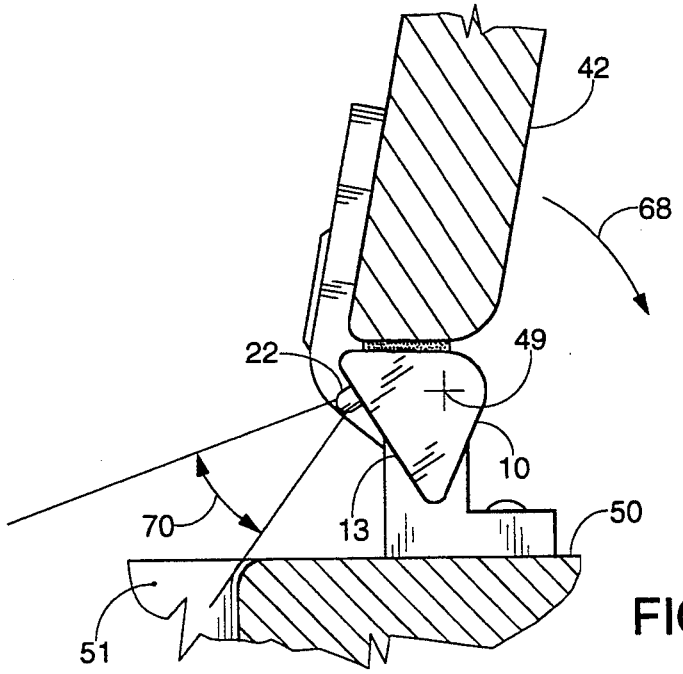
FIG. 6 shows the assembly of FIG. 5 in the bowl illuminating position.

FIG. 6. shows the assembly of FIG. 5 with seat ring 42 rotated about pivot axis 49 to its "up" or vertical position as indicated by arrow 68. Bottom wall 13 of preferred embodiment 10 is now rotated so as to reverse its inclination and that of gravity actuated switch 26. Thus, switch 26 is actuated to complete the circuit of battery 20 with lamp 22 and project its light toward interior 51 of toilet bowl 50. LEDs are commercially available with various light distribution characteristics and, in preferred embodiment 10, conical pattern 70 with an included angle of approximately 30° illuminates interior 51 effectively.

It is to be understood that the present invention is not limited to the disclosed embodiments and may be expressed by rearrangement or modification or substitution of parts, in particular, different types of batteries, lamps and switches within the spirit of the invention.

I claim:

1. Apparatus for illuminating the interior of a toilet bowl comprising:

an electric battery;

a lamp;

housing means for holding said lamp and battery in assembly;

means for pivotally mounting said housing means to the toilet bowl for rotational movement between a first, raised position wherein said lamp is directed at the interior of the toilet bowl and a second, lowered and protected position wherein said housing is displaced from exposure to the interior of the toilet bowl, said mounting means including a rear face which is proximate the pivotal axis and substantially vertical when said mounting means is in the lowered position; and means for operably connecting said lamp to said battery as said housing is rotated to said first position so that light from said lamp is directed into the interior of the toilet bowl.

2. Apparatus according to claim 1 wherein said pivotal mounting means comprises:

a toilet seat ring located above the interior of the toilet bowl, supported by and pivotally attached to the top surface of the toilet bowl; and means for attaching said housing to said toilet seat ring.

3. Apparatus according to claim 1 wherein said means for operably connecting said battery and said lamp is a gravity actuated electrical switch.

4. Apparatus according to claim 1 wherein said housing means is sealed so as to prevent water leakage into said lamp and battery assembly.

5. Apparatus for attachment to a toilet for illumination of the interior of the toilet bowl comprising:

a battery;

a lamp;

a seat ring pivotally mounted on said toilet for rotation between a raised and a lowered position, said seat ring including a rear face which is proximate the pivotal axis and substantially vertical when said seat ring is in the lowered position;

a gravity actuated switch in assembly with said battery and lamp so that tilting of said assembly operably connects said battery and said lamp to provide illumination;

a housing for containing said assembly of switch, battery and lamp, said housing including means for external projection of illumination from said lamp;

means for attachment of said housing at said rear face so that pivotal movement of said seat ring tilts said housing to provide illumination of the toilet bowl interior when said seat ring is raised and displaces said housing from exposure to the toilet bowl interior when said seat ring is lowered.

6. Apparatus according to claim 5 wherein said gravity actuated electrical switch is a mercury switch.

7. Apparatus according to claim 5 wherein said housing is sealed so as to prevent water leakage into said lamp and battery assembly.

* * * * *